US010364085B2

(12) United States Patent
Resurreccion, Jr.

(10) Patent No.: US 10,364,085 B2
(45) Date of Patent: Jul. 30, 2019

(54) MICROWAVE HEATING PACKAGE WITH POLARIZED SHIELD

(71) Applicant: Graphic Packaging International, LLC, Atlanta, GA (US)

(72) Inventor: Fermin P. Resurreccion, Jr., Thornton, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 126 days.

(21) Appl. No.: 15/229,512

(22) Filed: Aug. 5, 2016

(65) Prior Publication Data

US 2017/0043936 A1 Feb. 16, 2017

Related U.S. Application Data

(60) Provisional application No. 62/282,794, filed on Aug. 11, 2015.

(51) Int. Cl.

| | |
|---|---|
| ***H05B 6/80*** | (2006.01) |
| ***H05B 6/64*** | (2006.01) |
| ***B65D 81/34*** | (2006.01) |

(52) U.S. Cl.

CPC ..... *B65D 81/3453* (2013.01); *H05B 6/6408* (2013.01); *H05B 6/6494* (2013.01); *B65D 2581/3447* (2013.01)

(58) Field of Classification Search

CPC .. H05B 6/6408; H05B 6/6482; H05B 6/6491; H05B 6/6494; H05B 6/6499; H05B 6/80;

(Continued)

(56) References Cited

U.S. PATENT DOCUMENTS 5,593,610 A 1/1997 Minerich et al.
5,698,127 A * 12/1997 Lai ..... B65D 81/3446 219/729

(Continued)

FOREIGN PATENT DOCUMENTS

CA 2 196 154 A1 7/1998
EP 0 206 811 B1 4/1992

(Continued)

OTHER PUBLICATIONS

International Search Report and Written Opinion for PCT/US2016/045746 dated Nov. 16, 2016.
Supplementary European Search Report for EP 16 83 5688 dated Mar. 20, 2019.

*Primary Examiner* — Hung D Nguyen
(74) *Attorney, Agent, or Firm* — Womble Bond Dickinson (US) LLP

(57) ABSTRACT

A microwave heating package with a polarized shield includes a tray and a cover and at least one microwave energy interactive element. The microwave energy interactive element is dimensioned and arranged to extend along a peripheral region of a food item in an interior of the tray. The microwave energy interactive element reduces heating along the peripheral region of the food item when the microwave energy interactive element is exposed to microwave energy. The tray and the lid of the construct can each include at least one microwave energy interactive element.

15 Claims, 8 Drawing Sheets
(2 of 8 Drawing Sheet(s) Filed in Color)

(58) Field of Classification Search
CPC ..... B65D 81/3446; B65D 81/3453; B65D 2581/3447
USPC ..... 219/725, 728, 729, 730, 732, 734, 759
See application file for complete search history.

(56) References Cited

U.S. PATENT DOCUMENTS

| | | | | |
|---|---|---|---|---|
| 8,785,826 | B2 | 7/2014 | Lai | |
| 8,821,950 | B2 | 9/2014 | Nilsson et al. | |
| 2003/0085223 | A1* | 5/2003 | Zeng | A47J 36/027 219/725 |
| 2009/0114644 | A1 | 5/2009 | Zhang et al. | |
| 2010/0006566 | A1 | 1/2010 | Lai | |
| 2010/0038359 | A1 | 2/2010 | Laubhan et al. | |
| 2014/0374953 | A1 | 12/2014 | Middleton et al. | |
| 2015/0375468 | A1 | 12/2015 | Wnek | |

FOREIGN PATENT DOCUMENTS

| | | | |
|---|---|---|---|
| EP | 0 650 905 | A2 | 5/1995 |
| EP | 0 547 185 | B1 | 2/1997 |
| EP | 0 921 992 | B1 | 11/2001 |
| EP | 2 164 299 | B1 | 5/2012 |
| EP | 2 722 293 | A1 | 4/2014 |
| EP | 2 974 973 | A1 | 1/2016 |
| WO | WO 2008/137525 | A2 | 11/2008 |
| WO | WO 2010/039720 | A1 | 4/2010 |
| WO | WO 2014/197438 | A1 | 12/2014 |

* cited by examiner

MICROWAVE HEATING PACKAGE WITH POLARIZED SHIELD

CROSS REFERENCE TO RELATED APPLICATION

This application claims the benefit of U.S. Provisional Patent Application No. 62/282,794 filed Aug. 11, 2015.

INCORPORATION BY REFERENCE

The disclosure of U.S. Provisional Patent Application No. 62/282,794, which was filed Aug. 11, 2015, is hereby incorporated by references for all purposes as if presented herein in its entirety.

BACKGROUND

Microwave ovens commonly are used as a convenient means of heating food items. However, when larger food items are heated in a microwave oven, some portions of the food may tend to reach the desired final heating temperature too early in the heating cycle and become dry or charred, while other portions remain underheated or even cold. Thus, there is a need for a package, container, or other construct that controls the rate of heating of the food item so that the food item is suitably and substantially uniformly heated at the end of the heating cycle.

SUMMARY

This disclosure is directed to a microwave heating construct (e.g., package, container, etc.) for heating a food item (i.e., food) in a microwave oven. The microwave heating construct includes one or more features for promoting more even heating of the food item. This disclosure is also directed to a method of heating a food item in a microwave oven using the microwave heating construct.

Briefly described, the construct may include a pair of opposed surfaces (panels, walls, etc.), each of which may include a microwave energy interactive element or component for altering the effect of microwave energy on a food item. The respective microwave energy interactive elements are generally positioned within the construct so that the microwave energy interactive elements are in an opposed, substantially parallel, aligned relationship with the food positioned between therebetween.

The microwave energy shielding elements may be generally annular in shape (i.e., ring-shaped, with the overall shape being circular, oval, elliptical, obround, etc.), such that the elements have an inner edge or perimeter and an outer edge or perimeter. The inner edge may be generally dimensioned so that, upon exposure to microwave energy, an electric field is generated for heating the adjacent food, which would otherwise be likely to be underheated. The outer edge may be generally dimensioned so that the outer edge extends along a periphery of the food item. The distance between the inner edge and outer edge may be generally selected to extend along a peripheral region of the food that would otherwise likely to be overheated. Thus, the microwave energy interactive elements are configured to enhance heating near the central portion of the food and reduce heating along the peripheral portion of the food, resulting in a more evenly heated food item.

In one exemplary embodiment, the construct may include a tray and a cover. The tray may include a base and at least one upstanding wall. The base and cover each include a microwave energy interactive element operative for reflecting substantially all impinging microwave energy. The microwave energy interactive element of the cover and the microwave energy interactive element of the tray are configured to have substantially the same size and shape as one another and may be positioned in an opposed, substantially parallel, substantially aligned relationship with one another. The respective microwave energy interactive elements may be dimensioned and positioned relative to a food item positioned therebetween as described above to provide even heating of the food item in a microwave oven.

Various other features, aspects, and embodiments of the present invention will be apparent from the following description and accompanying figures.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The description refers to the accompanying drawings in which like reference characters refer to like parts throughout the several views, and in which.

DETAILED DESCRIPTION

Various aspects of the disclosure may be illustrated by referring to the figures, in which like numerals refer to like components. It will be understood that although particular examples of microwave heating constructs are shown herein, the teachings of the present disclosure may be used with numerous other constructs in accordance with the principles described herein.

Figure 1A:
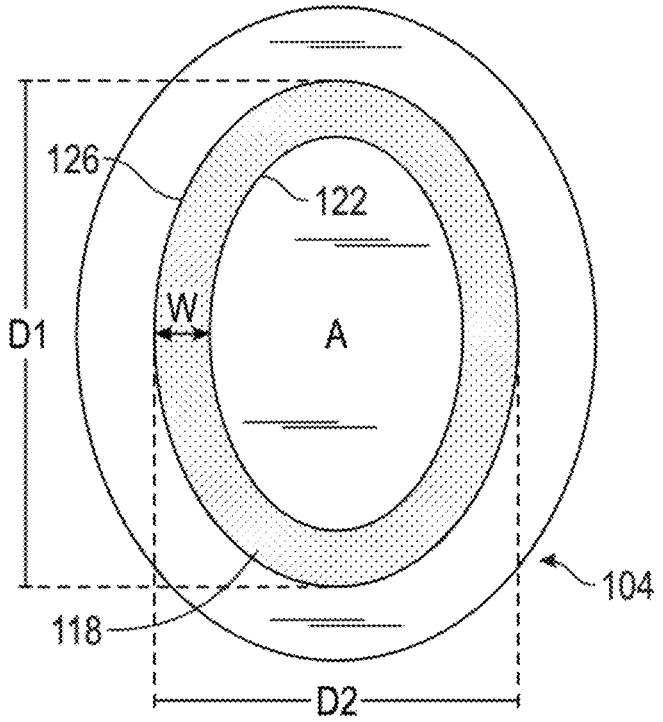
FIGS. 1A-1C schematically illustrate a top plan view of an exemplary microwave heating construct according to the present disclosure, including a tray and cover (interior side of each shown)
Figure 1B:
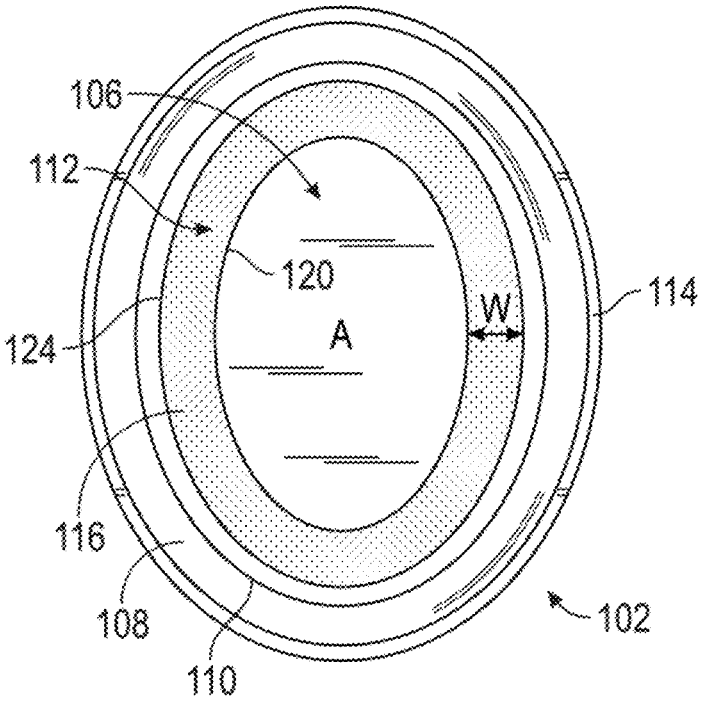
Figure 1C:
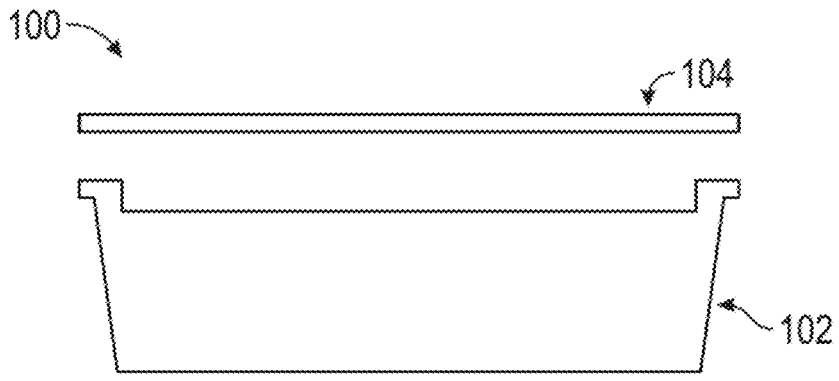

FIGS. 1A-1C schematically illustrate a top plan view of an exemplary microwave heating construct (e.g., package or container) 100. The construct 100 generally includes a first component (e.g., a tray) 102 for receiving the food and a second component (e.g., a lid or cover) 104 for overlying the tray 102.

In the illustrated embodiment, the tray 102 includes a base 106 (i.e., base panel) on which the food is to be seated, and at least one upstanding wall 108 extending upwardly from a peripheral edge 110 of the base 106. The base 106 and wall 108 generally extend around and define a cavity or interior space 112 for receiving a food item. The uppermost portion of the wall 108 may comprise a generally planar rim 114.

The base 106 of the tray 102 and the cover 104 each include a respective microwave energy interactive element 116, 118 (shown schematically with stippling). The microwave energy interactive elements may each generally comprise microwave energy interactive material, such as a metal foil or high optical density material, that is operative for reflecting substantially all of impinging microwave energy. It will be noted that, in FIGS. 1A-1C, the interior side of both the tray 102 and cover 104 are shown, and the microwave energy interactive elements 116, 118 (i.e., shielding elements) are depicted as being positioned on the interior side of the tray 102 and cover 104. However, in other embodiments, either or both of microwave energy interactive elements 116, 118 may be positioned on the exterior side of the tray 102 and/or cover 104.

As shown in FIGS. 1A-1C, the microwave energy interactive elements 116, 118 may be similarly sized and shaped. Specifically, in the illustrated example, microwave energy interactive elements 116, 118 are generally oval and annular in shape (such that the shape of the element could be described as an "oval annulus"); however, it will be appreciated that other shapes are contemplated by the present disclosure, for example, a circular annulus (i.e., ring-shaped or halo-shaped), elliptical annulus, obround annulus, etc. All of such shapes generally comprise a pair of closed curvilinear shapes that are generally concentric with one another to define the overall shape of the microwave energy interactive elements 116, 118.

Figure 4:
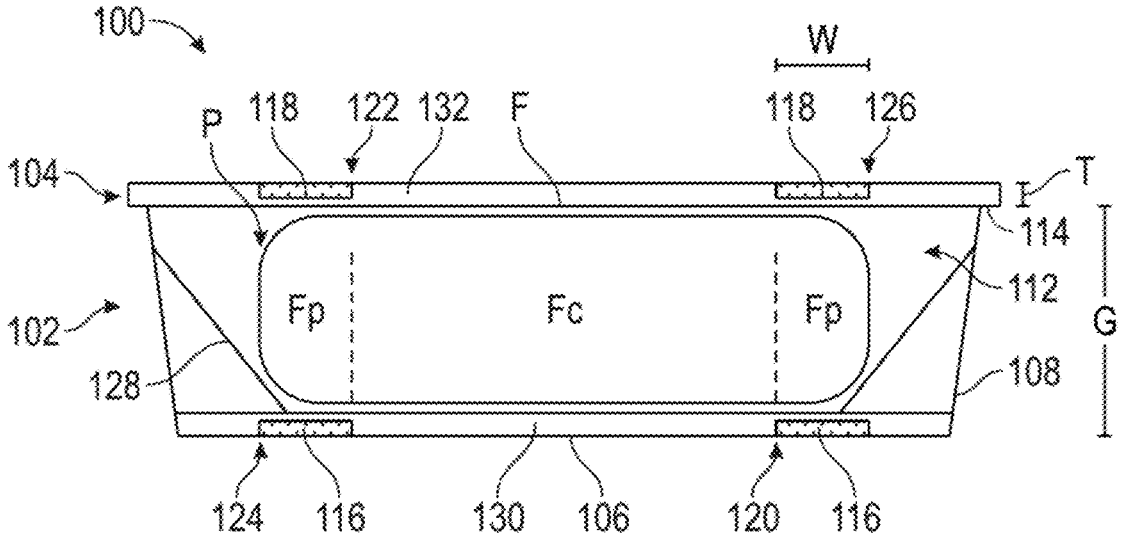
FIG. 4 schematically illustrates a cross-sectional view of the microwave heating construct of FIG. 3, taken along a line 4-4.
Figure 5A:
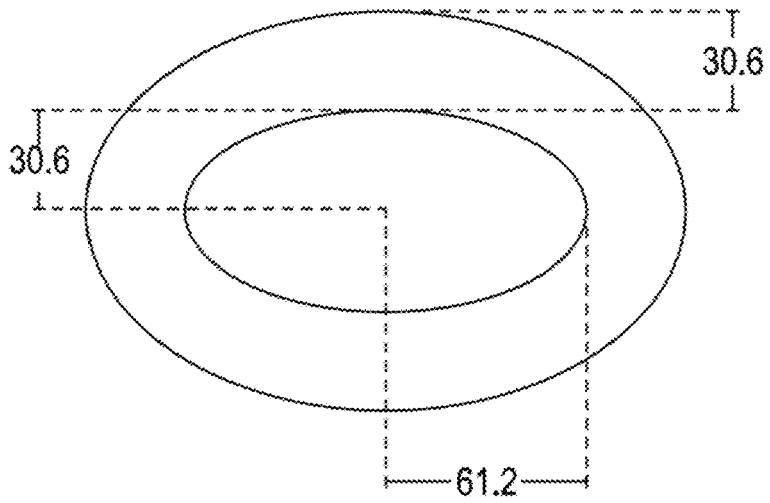
FIGS. 5A-5D schematically illustrate one configuration of exemplary microwave energy interactive elements according to the disclosure, used in the computer modeling of microwave heating of food in containers.
Figure 5B:
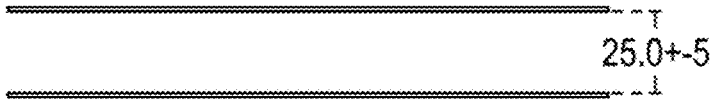
Figure 5C:
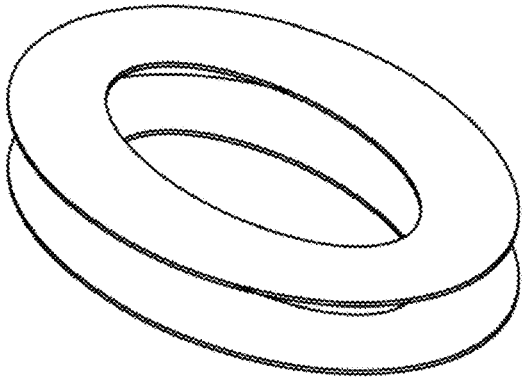
Figure 5D:
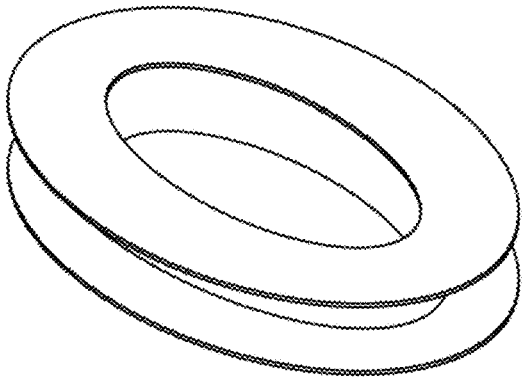

The elements 116, 118 also may be defined by and/or characterized as having a respective inner edge 120, 122 (having an inner edge length/perimeter) and a respective outer edge 124, 126 (having an outer edge length/perimeter), one or more diameters D1, D2 (only labeled on the cover 104) (e.g., major and minor diameters, a single diameter, or varying diameters, depending on the geometry of the element), an annular width W (the distance between the inner edge and the outer edge), and a thickness T (see FIG. 4, only labeled on the cover 104). The inner edge 120, 122 of each element 116, 118 defines a circumscribed area A, having its own geometric properties, as will be understood by those in the art.

Figure 2:
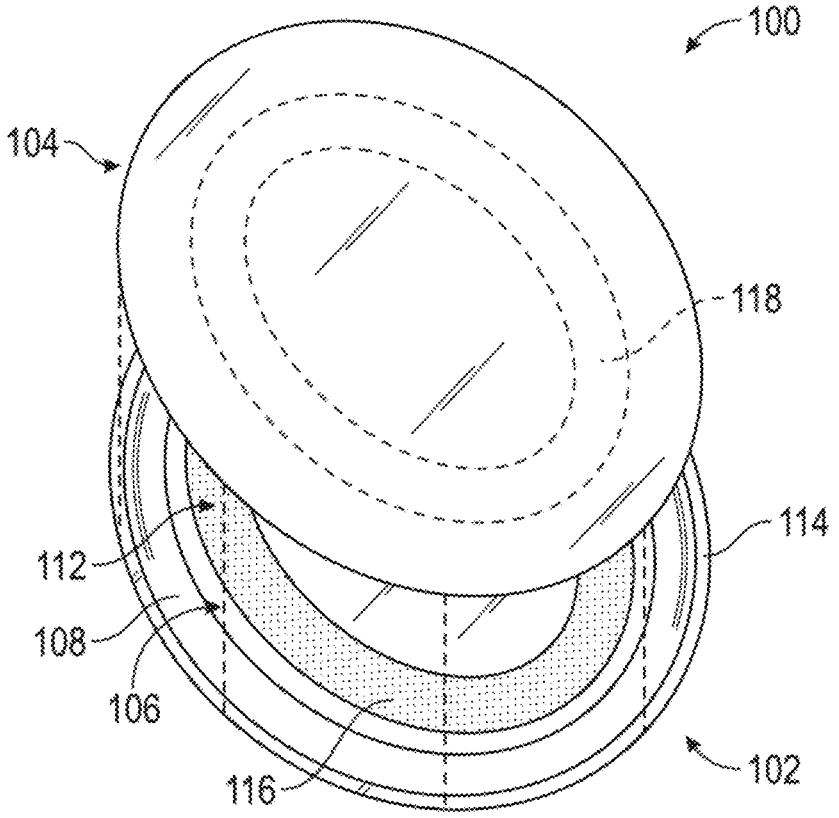
FIG. 2 schematically illustrates the microwave heating construct of FIG. 1, in a partially assembled (i.e., closed) configuration.
Figure 3:
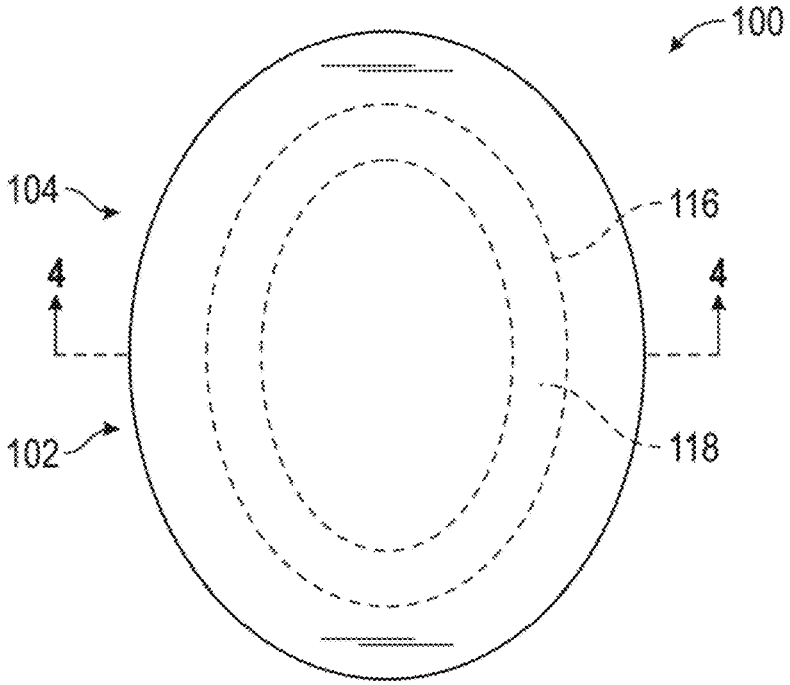
FIG. 3 schematically illustrates the microwave heating construct of FIG. 1, in a fully assembled (i.e., closed) configuration with the cover overlying the tray.

As shown in FIG. 2 (schematically depicting cover 104 partially positioned over tray 102), FIG. 3 (schematically depicting in top plan view the cover 104 positioned on tray 102, hidden from view), and FIG. 4 (schematically depicting the cross section only of the tray 102/cover 104 configuration of FIG. 3 taken along a line 4-4), the microwave energy interactive elements 116, 118 are positioned along the tray 102 and cover 104 to be in a substantially aligned, substantially parallel relationship when the cover 104 overlies the tray 102. It is therefore contemplated that the construct may include one or more features (not shown) that assist with the proper positioning of the first and second components (e.g., tray and cover) relative to one another. Such features may include, but are not limited to, a rim on the cover that fits tightly on to the tray, locking features, markings, locking contours (e.g., protrusions and corresponding depressions), and so on.

The precise dimensions, shape, and positioning of the microwave energy interactive elements 116, 118 within the construct 100 may vary for each food heating application, depending on, for example, the dielectric property of the food at various points during the heating cycle, the density of the food being heated, the volume and mass of the food being heated, and the dimensions of the tray 102 itself.

As best seen in FIG. 4, in general, the microwave energy interactive elements maybe configured so that the inner edge 120, 122 of elements 116, 118 is adjacent to (and generally extends around) a portion of the food F that would be typically prone to underheating, generally a central portion Fc of the food, while elements 116, 118 are configured to overlie a portion of the food that would typically be prone to overheating, generally a peripheral portion Fp of the food. Additionally, the outer edge 124, 126 of elements 116, 118 is substantially aligned with or adjacent to an outermost periphery P of the food F. Thus, it will be appreciated that the food-receiving component (e.g., the tray) may need to be designed with interior walls (e.g., sloped wall 128 in FIG. 4), contours, compartments, baffles, or other features that assist with maintaining the food item in proper alignment with elements 116, 118.

When the microwave energy interactive elements 116, 118 are appropriately dimensioned and positioned within the construct 100 relative to the food F in the manner described above, and exposed to microwave energy, the microwave energy interactive elements 116, 118 serve two independent, but complementary (and synergistic) effects during exposure to microwave energy.

First, each of the microwave energy interactive elements 116, 118 is dimensioned so that an electrical current is generated along the inner edge 120, 122 of the respective microwave energy interactive element 116, 118. In turn, an electric field is generated along the inner edge 120, 122 that provides direct heating to the adjacent, central portion Pc of the food, which would otherwise be likely to be underheated. Concurrently, microwave energy interactive elements 116, 118 reflect microwave energy away from the peripheral portion Fp of the food F, which would otherwise be likely to be overheated. Thus, the microwave energy interactive elements 116, 118 serve to both accelerate bulk heating near the center of the food, while shielding the outer portion of the food from being overheated.

To achieve these beneficial, synergistic effects, the microwave energy interactive elements 116, 118 may generally be dimensioned so that an inner perimeter length (the length of edge 120, 122) is approximately equal to one-quarter of the wavelength of microwave energy in the microwave oven. For example, in the case of a 2450 MHz oven, the inner perimeter length may be from about 20 mm to about 40 mm, for example, about 30 mm, and in one particular example, about 30.6 mm. In the case of a 915 MHz oven, the inner perimeter length may be from about 72 mm to about 92 mm, for example, about 82 mm, and in one particular example, about 81.97 mm. In the case of a 433.92 MHz oven, the inner perimeter length may be from about 163 mm to about 183 mm, for example, about 173 mm, and in one particular example, about 172.84 mm. In the case of an 896 MHz oven, the inner perimeter length may be from about 74 mm to about 94 mm, for example, about 84 mm, and in one particular example, about 83.71 mm. However, other frequencies and corresponding inner perimeter lengths are within the invention.

The outer perimeter length (the length of edge 124, 126) of elements 116, 118 may generally be approximately one-half of the wavelength of microwave energy in the microwave oven, for example, in the case of a 2450 MHz oven, from about 50 mm to about 70 mm, for example, about 60 mm, and in one particular example, about 61.2 mm. In the case of a 915 MHz oven, the outer perimeter length may be from about 154 mm to about 174 mm, for example, about 164 mm, and in one particular example, about 163.94 mm. In the case of a 433.92 MHz oven, the outer perimeter length may be from about 336 mm to about 356 mm, for example, about 346 mm, and in one particular example, about 345.68 mm. In the case of an 896 MHz oven, the outer perimeter length may be from about 158 mm to about 178 mm, for example, about 168 mm, and in one particular example, about 167.42 mm. However, other frequencies and corresponding outer perimeter lengths are within the invention.

Additionally, the distance or gap G (FIG. 4) between elements 116, 118 may generally be from about 20 to about 40 mm, for example, about 30 mm (depending on how dense the food is; a greater gap may be used with less dense foods, which heat more evenly). Finally, the thickness of elements 116, 118 may be at least about 1.5 micrometers.

The annular width W may vary, as needed to provide the proper amount of shielding. For example, the annular width W may be approximately equal to one-quarter of the wavelength of microwave energy in the microwave oven, for example, from about 20 mm to about 40 mm, for example, about 30 mm, and in one particular example, about 30.6 mm.

The construct 100 may be formed from various materials, including but not limited to, generally disposable materials such as paper, paperboard, and/or one or more polymeric materials (e.g., films, coatings, adhesives, etc.), provided that the materials are substantially resistant to softening, scorching, combusting, or degrading at typical microwave oven heating temperatures, for example, at from about 250° F. to about 425° F. For example, the microwave energy interactive elements 116, 118 may be disposed on (e.g., supported on, mounted to, deposited on, or otherwise joined to) a polymer film (or other substrate) 130, 132 (FIG. 4) for ease of handling and/or to prevent contact between the microwave energy interactive material and the food item. The polymer film including the microwave energy interactive element(s) may then be joined (adhesively or otherwise) to a dimensionally stable support comprising, for example, paperboard or a polymer/polymeric material (e.g., panel 106), so that the microwave energy interactive elements are positioned between the respective polymer film and support, and the exposed surface of the polymer film defines at least a portion of the food-contacting surface of the construct. The entire laminate may be thermally and/or mechanically pressed or molded (or shaped otherwise) to form the desired shape of the microwave heating construct. Alternatively, the polymer film including the microwave energy interactive element(s) may be joined (adhesively or otherwise) to a pre-shaped support.

Examples of polymer film substrates that may be suitable include, but are not limited to, polyolefins, polyesters, polyamides, polyimides, polysulfones, polyether ketones, cellophanes, or any combination thereof. In one particular example, the polymer film comprises polyethylene terephthalate. The thickness of the film generally may be from about 35 gauge to about 10 mil. In each of various examples, the thickness of the film may be from about 40 to about 80 gauge, from about 45 to about 50 gauge, about 48 gauge, or any other suitable thickness. Other non-conducting substrate materials such as paper and paper laminates, metal oxides, silicates, cellulosics, or any combination thereof, may also be used.

Where paperboard is used as the dimensionally stable support, the paperboard may have a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International. The support may also comprise a polymeric material, for example, crystalline polyethylene terephthalate (CPET) or other suitable material.

The construct may include one or more other microwave energy interactive elements, for example, a susceptor. A susceptor is a thin layer of microwave interactive material (generally less than about 100 angstroms in thickness, for example, from about 60 to about 100 angstroms in thickness, and having an optical density of from about 0.15 to about 0.35, for example, about 0.21 to about 0.28) that tends to absorb at least a portion of impinging microwave energy and convert it to thermal energy (i.e., heat) at the interface with a food item. Such elements often are used to promote browning and/or crisping of the surface of a food item. Other elements may comprise segmented foils that direct microwave energy to certain parts of the food item, arrays of reflective elements that can be tailored to affect bulk heating rates, and so on.

Although only specific embodiments are described herein, the microwave heating constructs of the present disclosure may have any suitable shape, dimensions, combination of microwave energy interactive elements, and so on. For example, although a somewhat elongate or oval construct with rounded ends is illustrated, other constructs may have the shape of a circle, obround, triangle, square, rectangle, pentagon, hexagon, heptagon, octagon, or any other suitable regular or irregular shape. Such constructs may have no distinct corners (e.g., as with a circle, which may be characterized as having no distinct corners or as comprising a continuous arrangement of corners), or may have one or more distinct corners, as with a triangle, square, or numerous other shapes. Any of such corners may be rounded in shape, and the degree of rounding (i.e., the radius of curvature) may vary for each application. Likewise, any of such constructs may have any suitable number of walls between the corners, and such walls may be substantially straight, curved, or any combination thereof. Thus, the present disclosure details a construct comprising a pair of opposed disks, a pair of opposed trays (with one tray serving as the cover for the other), integral components (e.g., hinged to one another), constructs in which the first and second components are similar in size or shape, constructs in which the first and second components differ in size or shape, and so on.

EXAMPLE

Computer modeling was used to simulate the microwave heating of food in two containers. The first container (control container) included no microwave energy interactive material. The second container (experimental container) included a pair of annular microwave energy shielding elements (as would be, for example, joined to a tray and cover), as described above and generally shown in FIGS. 5A-5D (dimensions in mm). The initial temperature of the food was −10° C. and the microwave power was set at 1250 watts. The heating time was 5 minutes. The dimensions of the heating space were based on those of a Panasonic NN-SN942 microwave oven.

Figure 6:
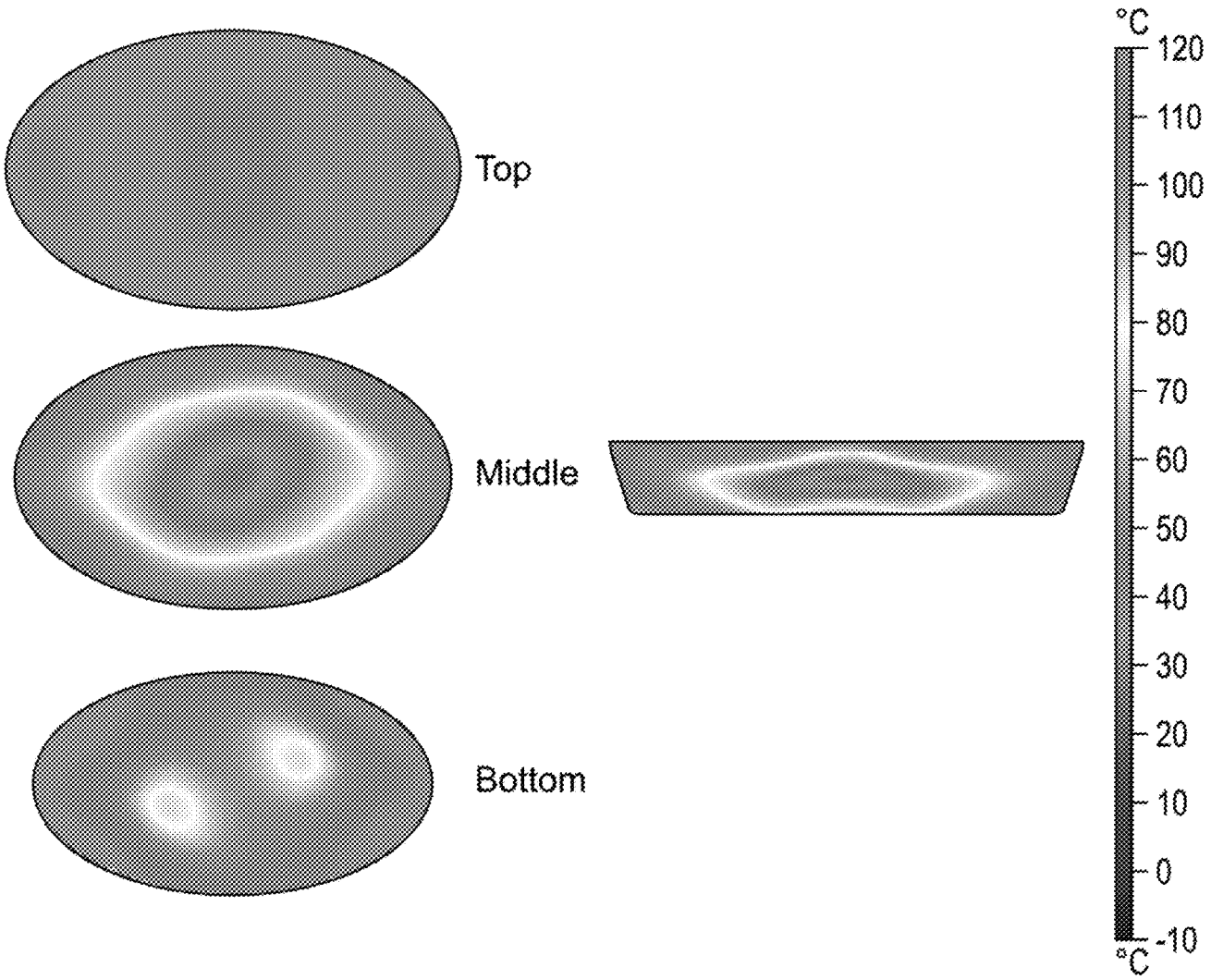
FIG. 6 illustrates the temperature profile of food heated in a container without microwave energy interactive elements, generated using computer modeling.
Figure 7:
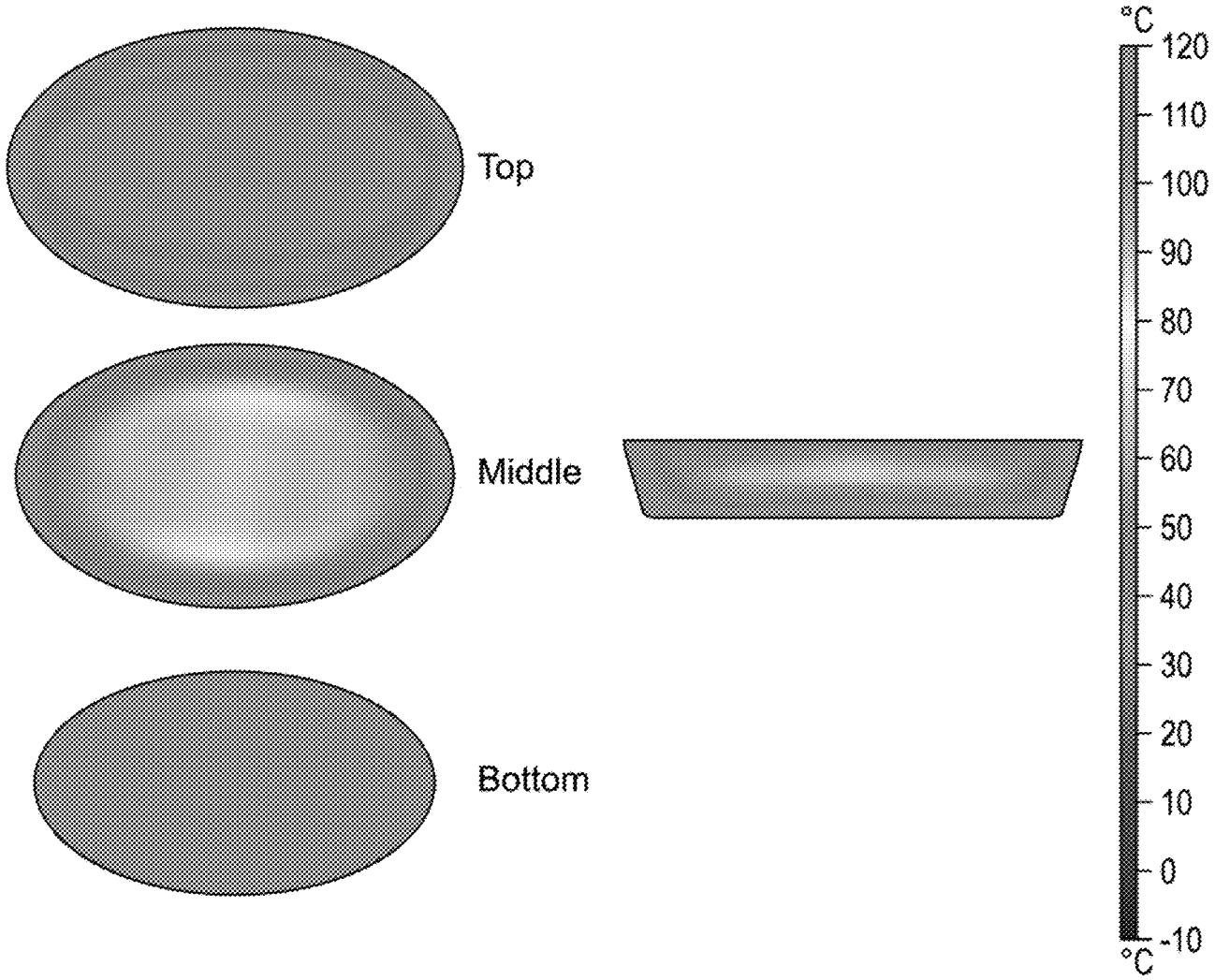
FIG. 7 illustrates the temperature profile of food heated in a container with microwave energy interactive elements according to FIGS. 5A-5D, generated using computer modeling.
Figure 8:
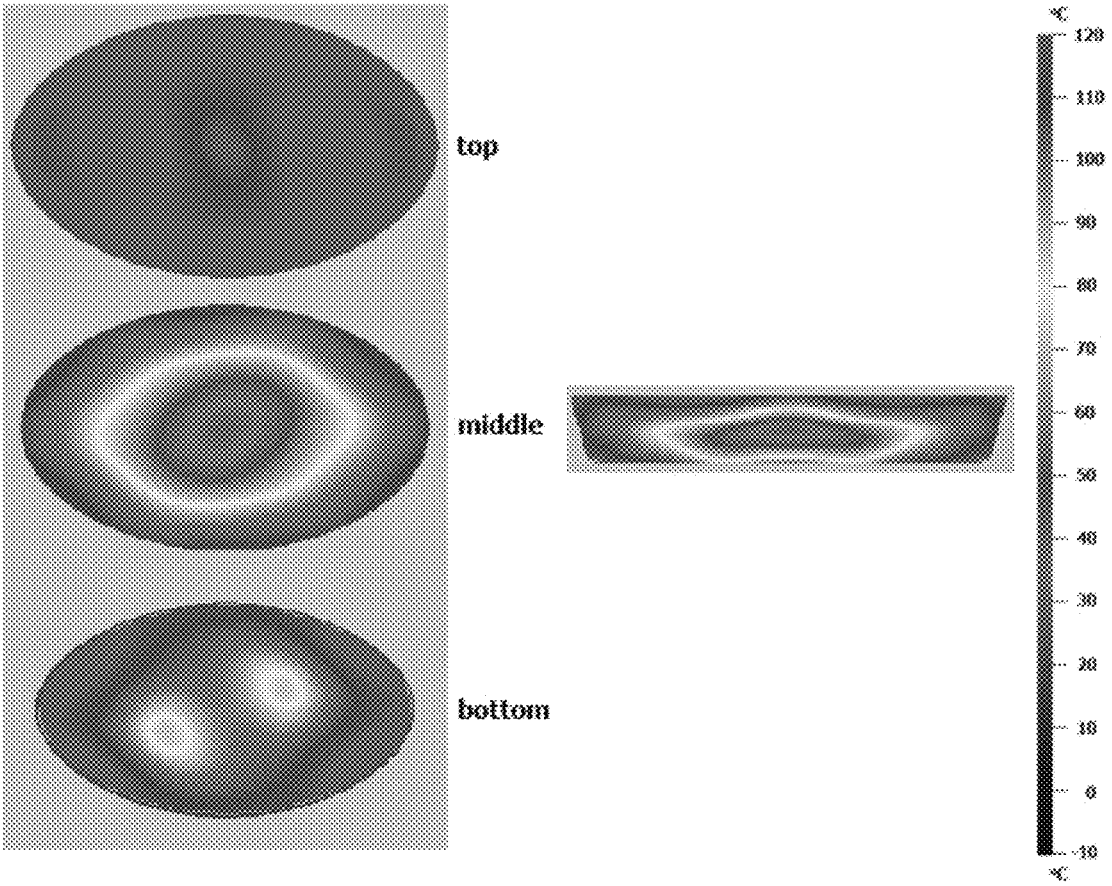
FIG. 8 is a color version of FIG. 6 and illustrates the temperature profile of food heated in a container without microwave energy interactive elements, generated using computer modeling.
Figure 9:
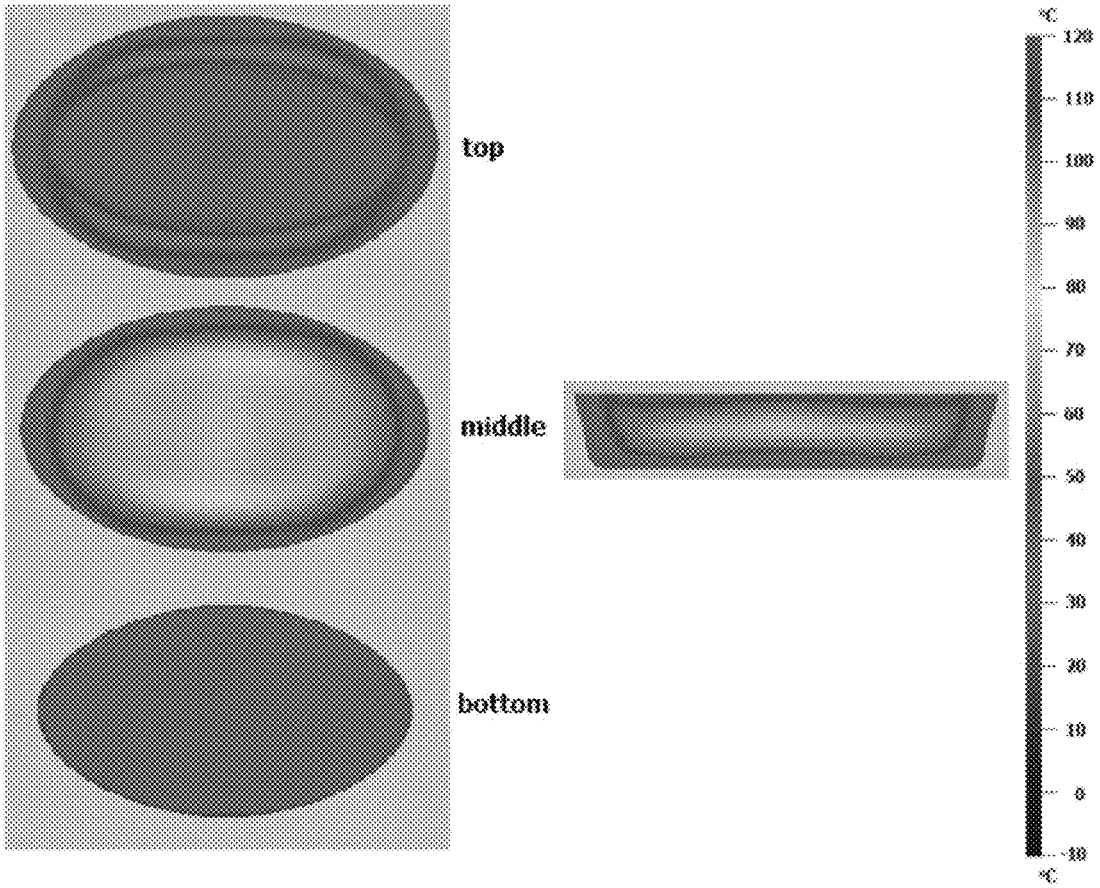
FIG. 9 is a color version of FIG. 7 and illustrates the temperature profile of food heated in a container with microwave energy interactive elements according to FIG. 5A-5D, generated using computer modeling.

As shown in FIG. 6, the geometric center of the control container was heated to a lower temperature than the peripheral areas. The lowest temperature in this region was about 25° C. A significant improvement was seen in heating uniformity using the experimental container, as shown in FIG. 7, with the geometric center of the container reaching a substantially uniform temperature of about 90-100° C. FIG. 8 is a color version of FIG. 6 and illustrates the temperature profile of food heated in a container without microwave energy interactive elements, generated using computer modeling. FIG. 9 is a color version of FIG. 7 and illustrates the temperature profile of food heated in a container with microwave energy interactive elements according to FIGS. 5A-5D, generated using computer modeling.

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A microwave heating construct comprising:

a tray including at least one upstanding wall extending upwardly from a base; the base and the wall of the tray defining a cavity for receiving a food item and a lid for enclosing the food item within the tray;

at least a first microwave energy interactive element on the base of the tray and a second microwave energy element on the lid, said first microwave energy interactive element being annular in shape and includes an inner perimeter edge, so that exposure of microwave energy to the inner perimeter edge will generate an electric current from the inner perimeter for heating the adjacent food item; the first and second microwave energy interactive elements each defining a substantially uniform width;

wherein the first microwave energy interactive element is dimensioned and arranged to extend along and overlap a peripheral region of the food item, the inner perimeter edge of the at least a first microwave energy interactive element has an inner perimeter length approximately equal to one-quarter of a wavelength of the microwave energy in a microwave oven in which the construct is heated;

wherein the first microwave energy interactive element includes an annular outer perimeter edge, said first and second microwave interactive elements being substantially concentrically aligned when said lid is placed onto a top of said tray;

wherein the first microwave energy interactive element along its width reduces heating along the peripheral region of the food item when the at least first microwave energy interactive element is exposed to microwave energy;

and wherein the second microwave energy interactive element along its width reduces heating along the peripheral region of the food item when the second microwave energy interactive element is exposed to microwave energy.

2. The microwave heating construct of claim 1 wherein, with the lid disposed over the tray, the first microwave energy interactive element and the second microwave energy interactive element are opposite one another in the cavity and being substantially the same size and shape.

3. The microwave heating construct of claim 1 wherein the wall includes a generally planar rim.

4. The microwave heating construct of claim 1 wherein heating of a central portion of the food item is enhanced as the peripheral region of the food is reduced by the first microwave energy interactive element and the at least a second microwave energy interactive element.

5. The microwave heating construct of claim 1 wherein the inner perimeter length of the first microwave energy interactive element has an inner perimeter length approximately equal to one-quarter of a wavelength of the microwave energy in a microwave oven in which the construct is heated and the second microwave energy interactive element has an inner perimeter length approximately equal to one-quarter of a wavelength of the microwave energy in a microwave oven in which the construct is heated.

6. The microwave heating construct of claim 1 wherein heating of a central portion of the food item is enhanced as the peripheral region of the food is reduced by the width of the first microwave energy interactive element.

7. A method of heating comprising:

forming a microwave heating construct comprising:

a tray including at least one upstanding wall extending upwardly from a base; the base and the wall of the tray defining a cavity for receiving a food item;

a cover;

first microwave energy interactive element on the base of the tray;

wherein the first microwave energy interactive element is dimensioned and arranged to extend along and overlap a peripheral region of the food item, the first microwave energy interactive element has an inner perimeter length approximately equal to one-quarter of a wavelength of the microwave energy in a microwave oven in which the construct is heated;

wherein the first microwave energy interactive element has outer perimeter length approximately equal to one half of a wavelength of the microwave energy in a microwave oven in which the construct is heated;

heating the microwave heating construct;

wherein the first microwave energy interactive element reduces heating along the peripheral region of the food item when the at least a first microwave energy interactive element is exposed to microwave energy.

8. The method of heating of claim 7 wherein the cover includes a second microwave energy interactive element.

9. The method of heating of claim 8 wherein, with the lid cover disposed over the tray, the first microwave energy interactive element and the second microwave energy interactive element are opposite one another in the cavity and substantially concentric with one another.

10. The method of heating of claim 8 wherein, with the cover disposed over the tray, the first microwave energy interactive element and the second microwave energy interactive element are in an aligned relationship in the cavity.

11. The method of heating of claim 8 wherein the wall includes a generally planar rim.

12. The method of heating of claim 8 wherein heating of a central portion of the food item is enhanced as the peripheral region of the food is reduced by the first microwave energy interactive element and the second microwave energy interactive element.

13. The method of heating of claim 8 wherein each of the first microwave energy interactive element and the second microwave energy interactive element has an inner perimeter length approximately equal to one-quarter of a wavelength of the microwave energy in a microwave oven in which the construct is heated.

14. The method of heating of claim 7 wherein heating of a central portion of the food item is enhanced as the peripheral region of the food is reduced by the first microwave energy interactive element.

15. The method of heating of claim 8 wherein each of the first microwave energy interactive element and a second microwave energy interactive element have an outer perimeter length approximately equal to one-half of a wavelength of the microwave energy in a microwave oven in which the construct is heated.

* * * * *